US011286143B2

(12) United States Patent
Lepoutre et al.

(10) Patent No.: US 11,286,143 B2
(45) Date of Patent: Mar. 29, 2022

(54) SAFETY SYSTEM AND LIFTING EQUIPMENT COMPRISING SUCH A SAFETY SYSTEM

(71) Applicant: HAULOTTE GROUP, L'Horme (FR)

(72) Inventors: Laurent Lepoutre, Givry (FR); Denis Pivot, Myans (FR)

(73) Assignee: HAULOTTE GROUP, L'Horme (FR)

( * ) Notice: Subject to any disclaimer, the term of this patent is extended or adjusted under 35 U.S.C. 154(b) by 96 days.

(21) Appl. No.: 16/634,767

(22) PCT Filed: Jul. 30, 2018

(86) PCT No.: PCT/EP2018/070558
§ 371 (c)(1),
(2) Date: Jan. 28, 2020

(87) PCT Pub. No.: WO2019/025345
PCT Pub. Date: Feb. 7, 2019

(65) Prior Publication Data

US 2020/0198952 A1 Jun. 25, 2020

(30) Foreign Application Priority Data

Jul. 31, 2017 (FR) ..... 1757313

(51) Int. Cl.
*B66F 11/00* (2006.01)
*B66F 17/00* (2006.01)
(Continued)

(52) U.S. Cl.
CPC ..... *B66F 17/006* (2013.01); *A62B 35/0075* (2013.01); *A62B 35/0093* (2013.01); *B66F 11/044* (2013.01)

(58) Field of Classification Search
CPC ..... A62B 35/0075; A62B 35/0093; B66F 11/004; B66F 17/006
See application file for complete search history.

(56) References Cited

U.S. PATENT DOCUMENTS 6,265,983 B1 * 7/2001 Baillargeon ..... A62B 35/0037 340/673
9,245,434 B2 * 1/2016 Baillargeon ..... B66F 17/006
(Continued)

FOREIGN PATENT DOCUMENTS

| | | | |
|---|---|---|---|
| FR | 3042718 | A1 | 4/2017 |
| JP | 2003-070928 | A | 3/2003 |
| KR | 20140079069 | A | 6/2014 |

OTHER PUBLICATIONS

International Search Report, dated Feb. 4, 2019, from corresponding PCT application No. PCT/EP2018/070558.
(Continued)

*Primary Examiner* — Alvin C Chin-Shue
(74) *Attorney, Agent, or Firm* — Nixon & Vanderhye

(57) ABSTRACT

Disclosed is a safety system for at least one person positioned on a platform of a lifting equipment, including a lanyard attaching the person to the platform. The length of the lanyard is variable, and the safety system includes: a sensor for measuring the distance between one end of the lanyard attached to the person and one end of the lanyard attached to the platform, and a unit for processing the measurement from the sensor, suitable for transmitting information and/or warning signals.

19 Claims, 5 Drawing Sheets

(51) Int. Cl.
*A62B 35/00* (2006.01)
*B66F 11/04* (2006.01)

(56) References Cited

U.S. PATENT DOCUMENTS

| | | | | |
|---|---|---|---|---|
| 2013/0200196 | A1 | 8/2013 | Copin | |
| 2014/0138186 | A1 | 5/2014 | Macy | |
| 2015/0027808 | A1 | 1/2015 | Baillargeon et al. | |
| 2015/0284231 | A1 | 10/2015 | Grant | |
| 2016/0332856 | A1* | 11/2016 | Steedley | B66F 11/044 |
| 2017/0368387 | A1* | 12/2017 | Fife | A62B 35/0075 |
| 2019/0022439 | A1* | 1/2019 | Dillon | G08B 21/02 |
| 2020/0101330 | A1* | 4/2020 | Blackford | A62B 1/00 |

OTHER PUBLICATIONS

French Search Report, dated Apr. 13, 2018, from corresponding FR application No. 1757313.

* cited by examiner

SAFETY SYSTEM AND LIFTING EQUIPMENT COMPRISING SUCH A SAFETY SYSTEM

BACKGROUND OF THE INVENTION

Field of the Invention

The invention relates to a safety system for a person working on a platform of lifting equipment, as well as lifting equipment comprising such a safety system.

Description of the Related Art

Operators working on lifting equipment such as aerial lifts are generally equipped with personal protective equipment by which they are attached to the platform of the lifting equipment. Either a short lanyard is used to reduce the risk of ejection from the platform, in particular when it moves at a high speed, or a longer lanyard is used with a shock absorber to limit injuries in case of fall from a height.

KR20140079069 describes a piece of personal protective equipment comprising a harness, a lanyard, a shock absorber, a carabiner, sensors and a speaker. A first sensor detects whether the carabiner is detached from a receptacle fastened to the harness and emits a sound message if this is not the case. A second sensor detects whether the shock absorber is relaxed. This device does not detect whether the carabiner is attached to an outside anchor point. Using separate sensors for each function makes it a complex and costly device.

U.S. Pat. No. 6,265,983 describes a safety device that detects whether an electrically conductive lanyard loop, connecting the operator to the platform, is attached and informs the operator if it is not attached. The controls are blocked if the operator is not attached. The detection is done by an electric current passing through the lanyard. This safety device can easily be deactivated by an operator by substituting a short metallic cable for the lanyard.

US2015284231 describes an aerial lift equipped to detect the presence of harnesses in the platform using RFID techniques. This device does not detect whether the harnesses are mechanically attached to the platform.

SUMMARY OF THE INVENTION

The invention aims to resolve these drawbacks by proposing a new safety system making it possible to improve the detection of risks for people located on the platform of lifting equipment.

To that end, the invention relates to a safety system for at least one person located on a platform of lifting equipment, comprising a lanyard by which the person is attached to the platform. According to the invention, the lanyard has a variable length, while the safety system comprises:

- a sensor for measuring the distance between an end of the lanyard attached to the person and an end of the lanyard attached to the platform,
- a processing unit for the measurement from the sensor, suitable for sending information and/or warning signals.

Owing to the invention, the position of the operator on the platform of the lifting equipment can be observed and the safety system can trigger processing operations taking incurred risks into account.

According to advantageous but optional aspects of the invention, such a system may incorporate one or more of the following features, considered in any technically allowable combination:

- the safety system comprises a winder with automatic return of the lanyard, while the sensor measures the length unwound between the two ends of the lanyard.
- the lanyard is kept tensed by the winder with automatic return.
- the measuring sensor is chosen from among a multi-turn potentiometer, an optical or magnetic sensor, or a roller.
- the measuring sensor and the processing unit of the measurement from the sensor are provided on the lanyard.
- the lanyard is fastened permanently to a safety harness equipping the person located on the platform.
- the processing unit is suitable for sending information and/or warning signals to a control unit of the lifting equipment.
- the processing unit for the measurement from the sensor is suitable for sending the information and/or warning signals to a remote electronic device.
- the safety system comprises a temporal recording memory for the measurements done by the sensor and usage events of the lanyard.
- at least one information signal comprises an instruction to limit the possibility of movement on the ground and/or the movements of a lifting structure of the lifting equipment as a function of the value of the distance between the two ends of the lanyard.
- the safety system is suitable for emitting a warning signal when the distance between the two ends of the lanyard is smaller than a low value corresponding to an attached state of the person but not separated from an attachment point.
- the safety system is suitable for emitting a warning signal when the distance between the two ends of the lanyard is substantially equal to a maximum value corresponding to the maximum length of the lanyard, indicating a fall state of the person.
- the warning signal is combined with the sending of a limitation instruction or prohibition against movement on the ground of the lifting equipment and/or movements of a lifting structure of the lifting equipment.
- at least one of the information signals comprises an authorization for movements on the ground of the lifting equipment without speed limit when the distance between the two ends of the lanyard is between a low value, corresponding to an attached state of the person but not separated from an attachment point, and an intermediate value above the low value, corresponding to an anti-ejection configuration of the person.
- one of the information signals comprises an instruction to limit the ground movement speed of the lifting equipment when the distance between the two ends of the lanyard is between an intermediate value corresponding to an anti-ejection configuration of the person and an edge value, corresponding to the separation of the person on an edge of the platform.
- one of the information signals comprises an instruction prohibiting the ground movement of the lifting equipment and/or movements of a lifting structure of the lifting equipment when the distance between the two ends of the lanyard is between an edge value corresponding to the separation of the person on an edge of the platform and a maximum value, corresponding to the maximum length of the lanyard.

the safety system is suitable for emitting a warning signal in case of detection of a distance greater than a maximum value corresponding to the maximum length of the lanyard, or in case of detection of a distance smaller than a minimum value corresponding to the length of the lanyard fully wound.

the safety system is suitable for emitting a warning signal in case of detection of a non-variation period of the distance between the two ends of the lanyard greater than a threshold duration.

The invention also relates to lifting equipment comprising a lower part, a lifting structure and a platform carried by the lifting structure. According to the invention, the lifting equipment comprises at least one safety system according to the preceding, suitable for being carried by at least one person located on the platform, while the processing unit of the safety system is suitable for transmitting information and/or warning signals to a control unit of the lifting equipment, suitable for controlling the functionalities of the lifting equipment as a function of information and/or warning signals received from the safety system.

BRIEF DESCRIPTION OF THE DRAWINGS

The invention will be better understood, and other advantages thereof will appear more clearly, in light of the following description of a safety system and lifting equipment according to its principle, provided as a non-limiting example in reference to the appended drawings, in which.

DESCRIPTION OF THE PREFERRED EMBODIMENTS

Figure 1:
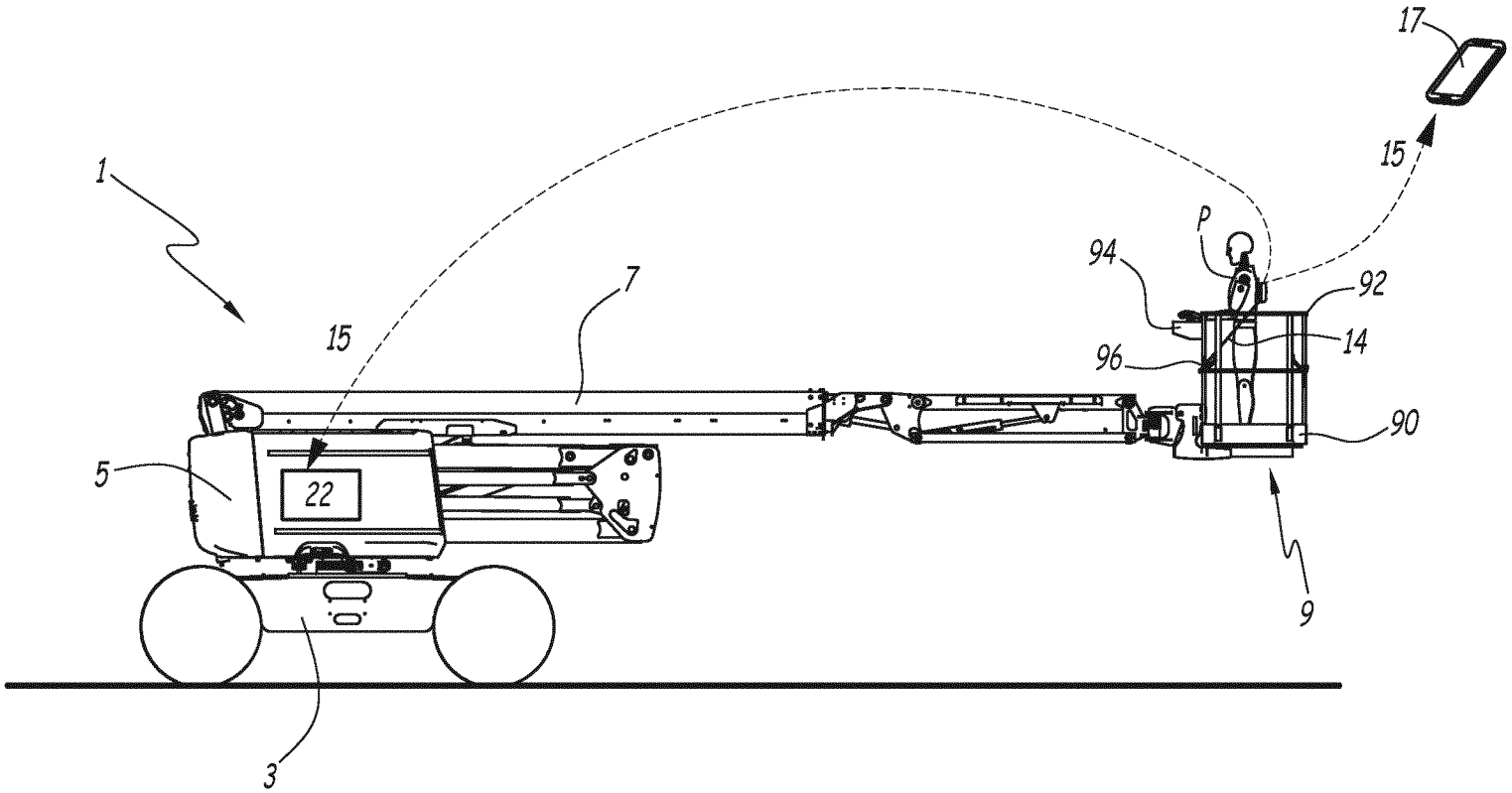
FIG. 1 is a perspective view of an aerial lift, comprising a platform on which a person stands connected to the platform by a safety system according to the invention, the aerial lift being in the folded configuration.
Figure 2:
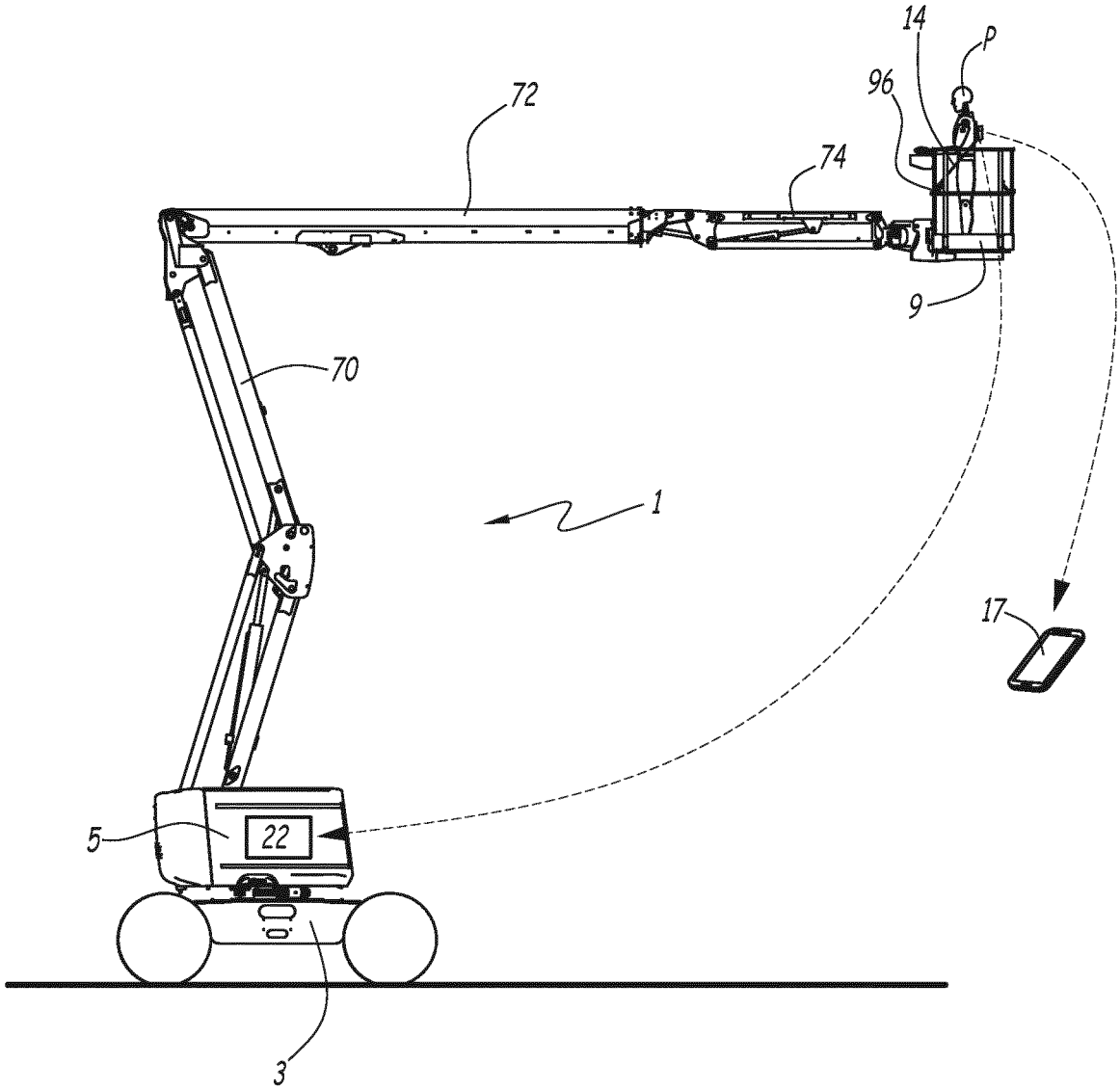
FIG. 2 is a view similar to FIG. 1, in the deployed configuration of the aerial lift.

FIG. 1 shows an aerial lift 1 including a bottom portion having a chassis 3 equipped with ground connecting members, such as wheels or tracks. The bottom portion also includes a turret 5 rotatable relative to the chassis 3 along an axis perpendicular to the rotation axes of the wheels, a lifting structure 7 and a platform 9 supported by the lifting structure 7. The platform 9 includes a wire floor 90 surrounded by a guardrail 92. The platform 9 is equipped with a control console 94 allowing a person P present on the platform 9 to control the aerial lift 1, that is to say, the movement of the chassis 3 relative to the ground, the movements of the platform 9 relative to the chassis, the starts/stops, etc.

In this example, the lifting structure 7 includes a deploying lower arm 70, an upper arm 72 and a pendular arm 74. The movements allowed by the arm 70, 72 and 74 are known in themselves and will not be described in further detail below.

In order to secure the operations of the person P standing in the platform 9, the aerial lift 1 comprises a safety system 12 comprising a lanyard 14 by means of which the person P is attached to the platform 9. The lanyard 14 comprises a ribbon 141 forming the physical link between the person P and the platform 9. This ribbon 141 includes an end 140, forming a first end of the lanyard 14, attached to a fastening point 96 of the platform 9. The lanyard 14 comprises a second end 142, which is attached to a harness 16 equipping the person P. The lanyard 14 makes it possible to prevent the person P from falling in different usage configurations of the aerial lift 1.

The lanyard 14 has a variable length, and the safety system 12 is equipped with a sensor 18 for measuring the distance L between the two ends of the lanyard 14, and a processing unit 20 for the measurement from the sensor 18, suitable for emitting information and/or warning signals 15. This makes it possible to correlate the length of the lanyard 14, and therefore the position of the person P in the platform 9, to different safety situations that may occur during the use of the aerial lift 1, to warn or inform the person P wearing the safety system 12 of potential dangers or specific situations. People working at heights not necessarily being familiar with the operation and safety limitations of an aerial lift, their work and safety are therefore improved.

The lanyard 14 preferably comprises a self-blocking winder 144 with automatic return, according to a principle similar to that of motor vehicle seatbelts. The winder 144 is formed by a cap in which the ribbon 141 winds owing to a return mechanism, not shown. The sensor 18 therefore measures the unwound length of ribbon 141 to determine the distance L between the two ends of the lanyard 14.

The measuring sensor 18 can for example be a multi-turn potentiometer, or an optical or magnetic sensor detecting optical distance marks or metallic bands on the ribbon 141, or a roller in contact with the winder 144 and the rotations of which are measured, inter alia.

Preferably, the measuring sensor 18 and the processing unit 20 of the measurement from the sensor are provided on the lanyard 14. For example, the sensor 18 is mounted in the winder 144.

The processing unit 20 is formed by a casing containing electrical components connected to the sensor 18. The processing unit 20 can advantageously be fastened to the winder 144.

Figure 3:
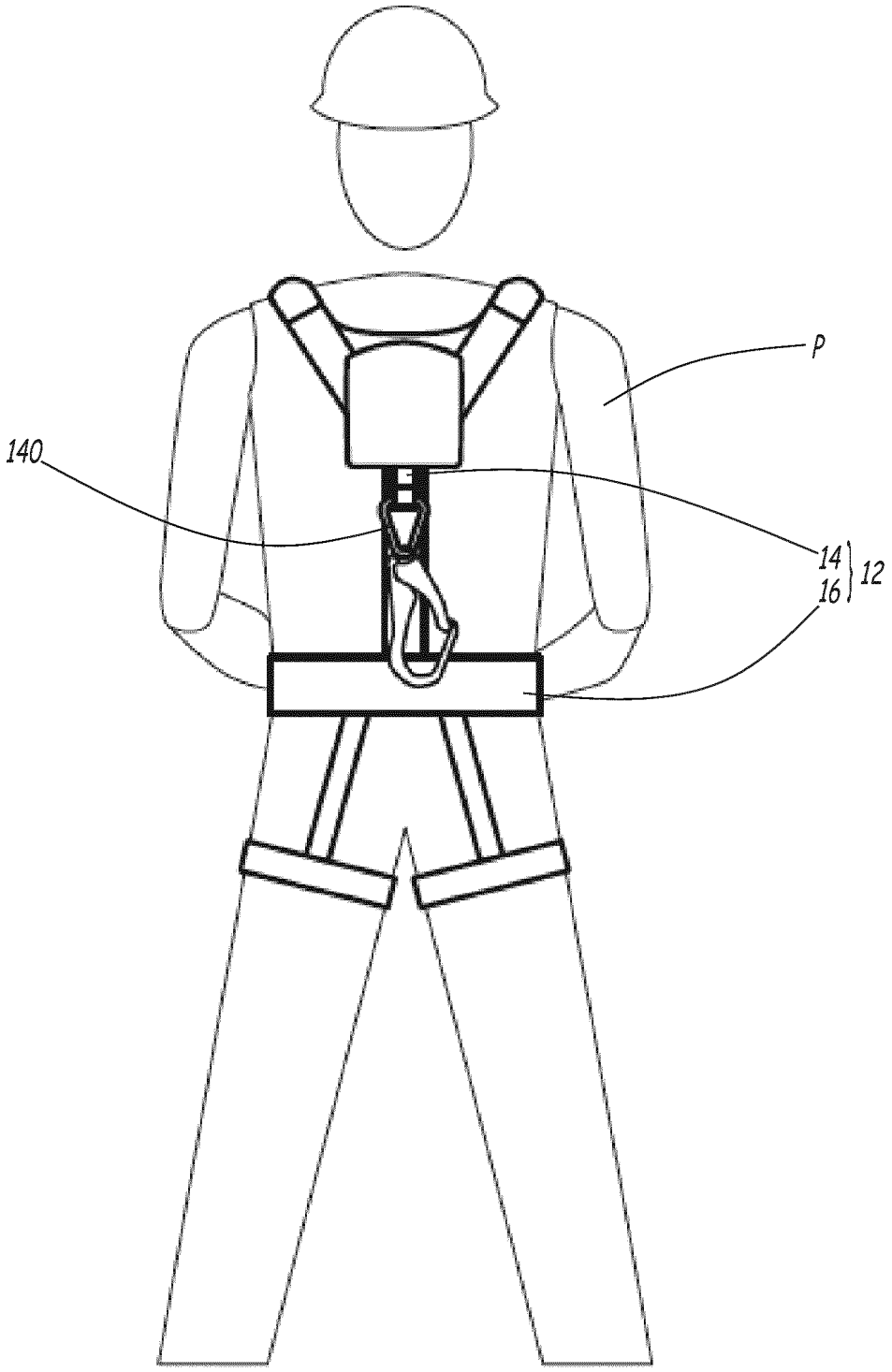
FIG. 3 is a view of a person equipped with a harness and a lanyard belonging to the security system according to the invention.
Figure 4:
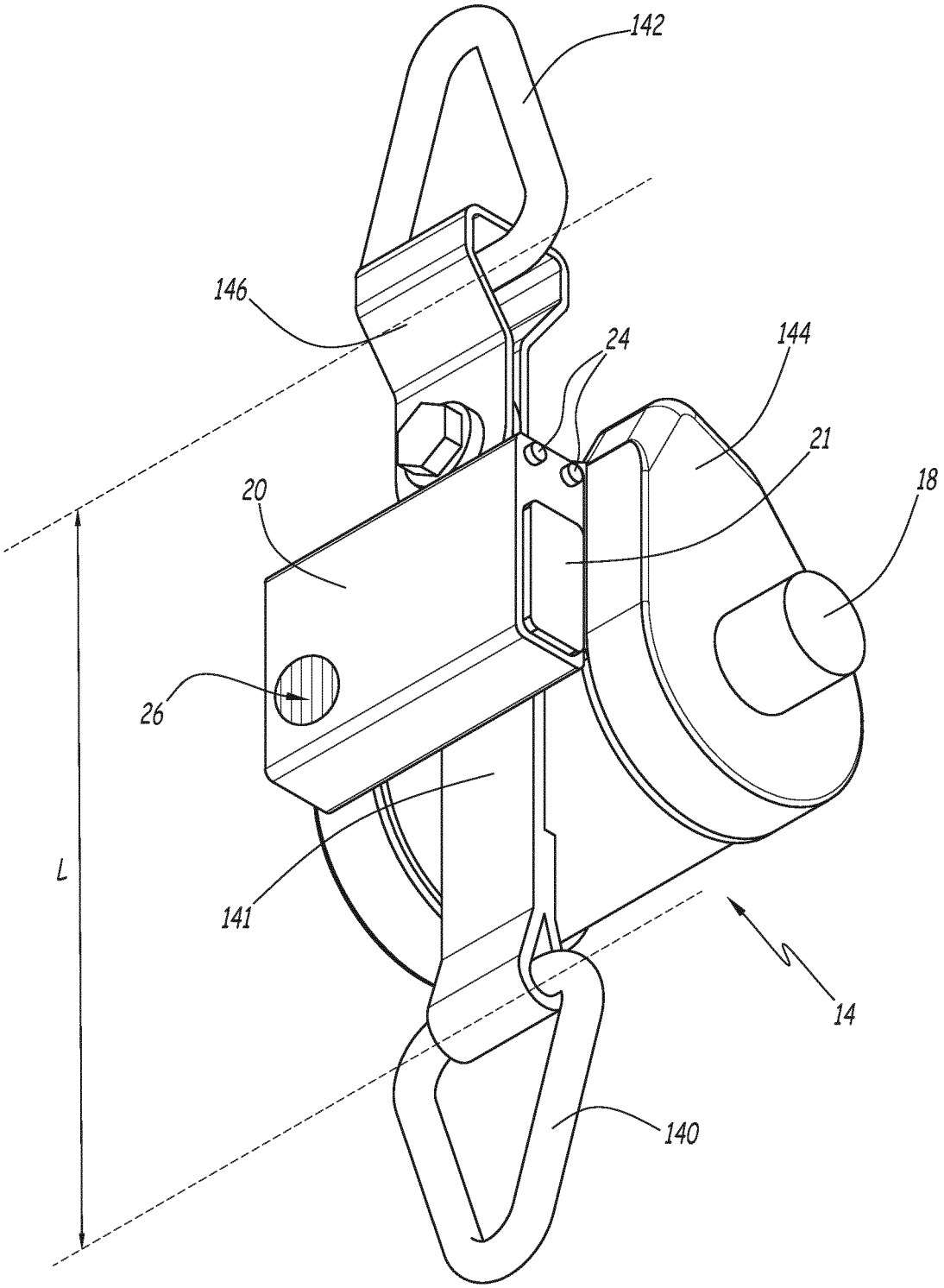
FIG. 4 is a perspective view of the lanyard of FIG. 3.
Figure 5:
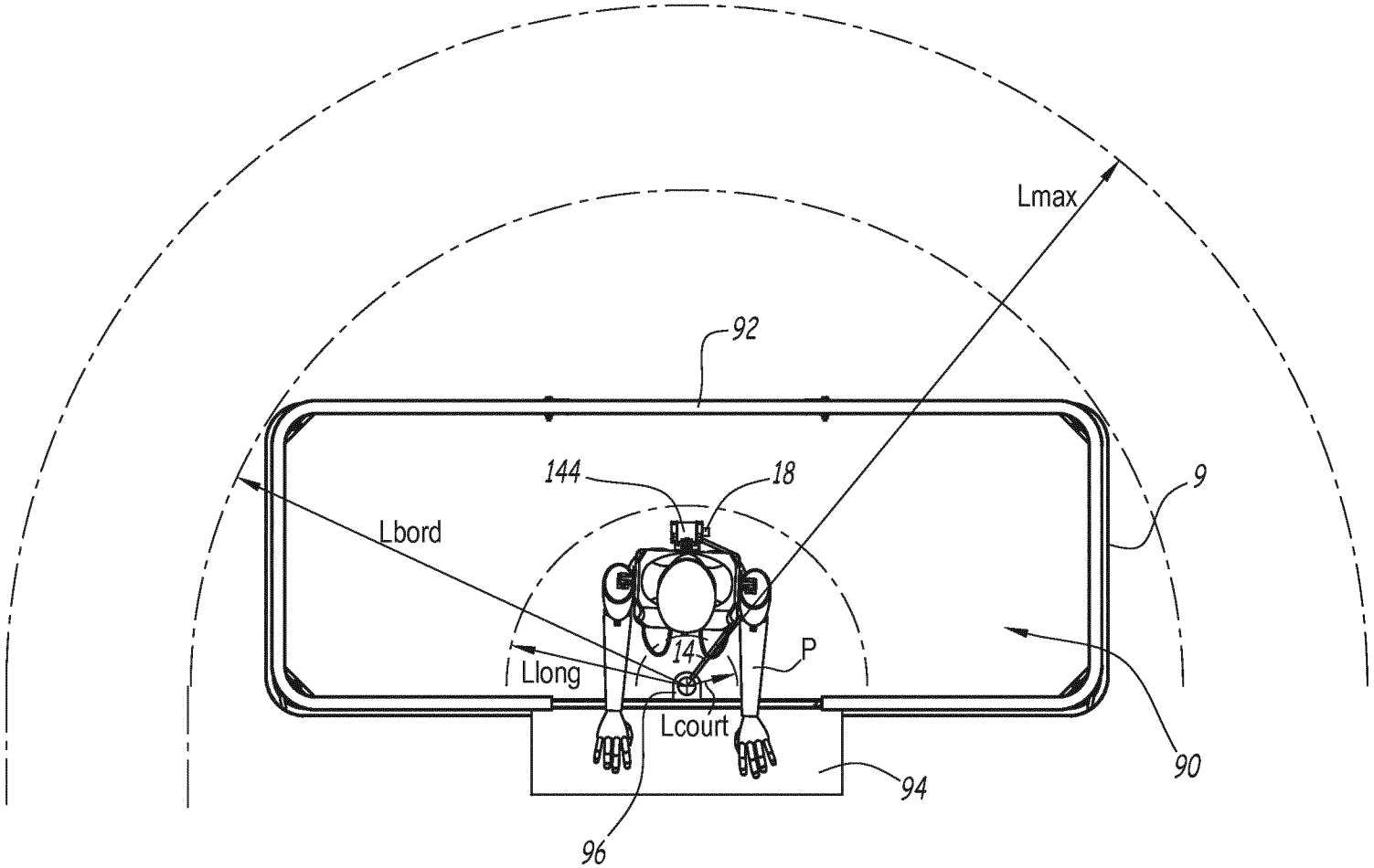
FIG. 5 is a top view of the platform of the aerial lift of FIG. 1, in which a person is standing.

As an example, the lanyard 14 can be fastened removably on the harness 16 equipping the person P, for example using a quick link forming the end 142. This quick link can be connected to the winder 144 and the processing unit 20 by a rigid element 146. In a variant, the lanyard 14 can be fastened permanently to the harness 16, and be an integral part of this harness 16, as shown in FIG. 3.

The lanyard 14 is equipped with an autonomous battery power supply, and an electronic board that incorporates the components of the processing unit 20. The casing containing the processing unit 20 comprises the battery whose housing is closed by a cover 21. The battery electrically powers the sensor 18, the processing unit 20, and the communication device.

The safety system 12 can comprise a temporal recording memory for the measurements done by the sensor and usage events of the lanyard 14. This memory dates the length variations of the lanyard 14, dates the attachments or detachments of the lanyard 14 on the platform 9, any flaws, etc., in order to use the data for statistical purposes, to improve the taking into account of values read by the sensor 18, to define new safety procedures, etc. The processing unit 20 can advantageously incorporate this memory.

The lanyard 14, and more generally the safety system 12, can operate autonomously, that is to say, with no connection to the aerial lift 1. In this case, the safety system 12 performs a warning and information function intended for the person P who is wearing it, or for the surrounding people, without modification of the usage parameters of the aerial lift 1.

The safety system 12 can emit, for the person P, a failure signal of the distance measuring sensor 15 in case of detection of a distance L below a minimum value corresponding to the length of the completely wound lanyard 14, or in case of detection of a distance greater than a maximum value Lmax, corresponding to the maximum length of the lanyard 14. In a first embodiment, the maximum length of the lanyard 14 is its length when it is completely unwound. In a second embodiment, the lanyard 14 is equipped with a fall indicator or a shock absorber—not shown—and the maximum length of the lanyard 14 is the addition of the length of the completely unwound lanyard and the additional length created by the activation of the fall indicator or the shock absorber.

When the length L of the lanyard 14 is below a low value Lcourt, corresponding to an attached state of the person P but not separated from the attachment point 96, indicating that the person has probably not attached the lanyard 14 to the platform 9, a sound signal, for example a warning, can be sent by the lanyard 14 with a recorded message, optionally accompanied by light signals, to encourage the person P to attach himself to the platform 9. The low value Lcourt can be equivalent to several centimeters.

The safety system 12 can also send a warning signal to the outside when the length L of the lanyard 14 is substantially equal to the maximum value Lmax, indicating a likely fall of the person P.

The safety system 12 can also send a warning signal in case of detection of a non-variation period of the distance L between the two ends of the lanyard 14 greater than a threshold duration. This threshold duration can for example be thirty seconds. This makes it possible to detect a physical problem of the person P. When the length L of the lanyard 14 does not vary for a duration greater than the threshold duration, the lanyard 14 can trigger a pre-warning sending a recorded message intended for the person P, ordering him to move in order to stop the warning. If, after a second period, the length of the lanyard 14 has still not varied, a warning is sent to the outside. An image capture and image viewing system, not shown, provided on the chassis 3 can then be implemented to assist the person P potentially in danger. A system of this type is described in application FR 1,654,415.

The lighted and/or sound signals can be sent on the lanyard 14, or on the harness 16 equipping the person P. The casing containing the processing unit 20 can in particular include indicators 24 displaying lighted signals, and a sound transmitter 26. The indicators 24 and the sound emitter 26 are supplied with electricity by the battery of the lanyard 14.

Certain warning or information signals 15 can also be sent to a remote electronic device 17 such as a mobile telephone, a computer, a server for relaying this information to a supervisor, a centralized safety system of a worksite, maintenance or medical intervention teams, etc.

The lanyard 14 is preferably attached to the person P on the latter's back. In some cases, in particular if the person P is located in front of the control console 94 and attached to the attachment point 96, the lanyard 14 can partially surround the body of the person P. The processing unit 20 is suitable for weighting the value measured by the sensor 18 to take account of a particular orientation of the person P, for example by taking account of a margin of error of 20% on the measured value.

The aerial lift 1 comprises a control unit 22, which encompasses sensors, processors and software processing all of the operating data of the aerial lift 1 in order to control the movement means of the lift structure 7 and the aerial lift 1 relative to the ground.

According to an advantageous optional embodiment of the invention, the safety system 12 comprises a communication device, not shown, for example wired or wireless, allowing communication with the control unit 22. This communication device can advantageously be incorporated into the processing unit 20.

The control unit 22 can implement certain processing operations as a function of the information/warnings 15 received from the safety system 12. In particular, the control unit 22 is suitable for controlling the functionalities of the aerial lift 1 as a function of the information signals received from the safety system 12. This may consist of emitting a visual or sound signal, and limiting the possibility of ground movement of the aerial lift 1 and/or the movements of the platform 9 by the lift structure 7 as a function of the value of the distance L between the two ends of the lanyard 14.

The signal 15 emitted by the safety system 12 may comprise information that the distance L between the two ends of the lanyard 14 is smaller than the low value Lcourt, indicating that the person has probably not attached the lanyard 14 to the platform 9. The control unit 22 receiving this information then emits a visual or sound signal to encourage the person to attach the lanyard 14 when he is on the platform 9. Advantageously, this warning transmitted via the signal 15 is combined with the sending, via the signal 15, of an instruction to prohibit or limit the ground movement of the aerial lift 1 and/or movement of the lift structure 7.

The ground movement of the aerial lift 1 generates major shaking of the platform 9, due to the presence of the lift structure 7 and the significant lever arm between the chassis 3 and the platform 9. As a result, when a person P stands on the platform 9, he is subject to major instability when the ground speed of the aerial lift 1 increases. To avoid being ejected, the person P must be connected to the platform 9 by a short lanyard 14, which only allows him limited movements relative to the attachment point and prevents him from passing over the guardrail 92 in case of violent impacts.

The signal 15 sent by the safety system 12 therefore comprises an authorization for ground movements of the aerial lift 1 without speed limit when the distance L between the two ends of the lanyard 14 is between the low value Lcourt and an intermediate value Llong, greater than the low value Lcourt, corresponding to an anti-ejection configuration of the person P. "Anti-ejection configuration" refers to a length value of the lanyard 14 short enough to keep the person P on the platform 9 and prevent him from passing over the guardrail 92 in case of ejection. The length Llong can be less than 1 meter, for example 50 centimeters. In this case, the person P can, by means of the control console 94, steer the aerial lift 1 relative to the ground at the maximum speed provided by the characteristics of the equipment.

The signal 15 can also comprise an instruction to limit the ground movement speed of the aerial lift 1 when the distance L between the two ends of the lanyard 14 is between the intermediate value Llong and an edge value Lbord, corresponding to the separation of the person P on an edge of the platform 9, for example in a work situation in which the person P must pass his arms above the guardrail 92. The value Lbord can for example be 1.5 meters. In this configuration, the signal 15 can also control a limitation of the movement possibilities of the platform 9 by the lift structure 7, in particular in the case of aerial lifts not comprising ground movement means.

The signal 15 can also comprise an instruction to prohibit ground movement of the aerial lift 1 when the distance L between the two ends of the lanyard 14 is between the edge value Lbord and the maximum value Lmax, since the person P can have left the platform 9 to perform work outside the platform 9, for example on a roof. It can also involve a fall case if the distance L is substantially equal to the maximum value Lmax. This value Lmax can for example be 2 meters.

In both cases, a warning indicating the presence of a person outside the platform 9 is sent. In this configuration, the signal 15 can also control a prohibition against the movement possibilities of the platform 9 by the lift structure 7, in particular in the case of aerial lifts not comprising ground movement means, or an authorization only via a dedicated device, for example to assist the person P who has fallen, by establishing a specific movement to return to the ground.

When the distance L measured between the two ends of the lanyard 14 is greater than the maximum length Lmax of the lanyard 14 or less than the minimum value corresponding to the length of the completely wound lanyard 14, a failure or fault warning is sent, and in this case, the signal 15 sent to the control unit 22. It indicates a failure of the distance measuring sensor 18 and comprises a limitation or prohibition of the movements of the aerial lift 1. Optionally, only certain movements such as assistance movements, in particular return to the ground, can be done.

It can be considered for the aforementioned limitations and authorizations to be implemented jointly or independently as a function of the programming of the control unit 22. Furthermore, these limitations can be implemented in addition to the other limitations theoretically provided by the control system 22, in particular to limit the ground movement speed when the lift structure 7 is deployed and the platform 9 is at a height.

According to one embodiment that is not shown, the sensor for measuring the length between the ends of the lanyard 14 can measure the length of a cable separate from the lanyard 14 and stretched parallel thereto.

It can be considered for several safety systems 12 as previously cited to be used with the aerial lift 1, in order to secure several people P present on the platform 9.

The invention is not limited to an aerial lift with a turret and an articulated arm as shown in this example, and is also applicable to all types of aerial lifts for personnel, in particular lift structures of the type with a telescoping arm, scissors and vertical masts and non-self-propelled lifts mounted on a truck chassis, a trailer chassis or an industrial truck.

The technical features of the embodiments and alternatives described above may be combined with one another to form new embodiments of the invention.

The invention claimed is:

1. A lifting equipment comprising:

a lower portion resting on the ground;

a lift structure;

a platform carried by the lift structure;

a safety system for at least one person located on the platform, the safety system comprising:

a lanyard having a length that is variable, the lanyard comprising a first end and a second end that are spaced apart along the length by a distance of the lanyard, the first end being attached to an attachment point of the platform, the second end being configured to be attached to a person of the at least one person located on the platform, a measuring sensor providing a distance measurement for the distance of the lanyard, and a processor configured to process the distance measurement from the measuring sensor to send information signals including at least one instruction related to one or more of (i) ground movements for the lower portion and (ii) movements for the lift structure as a function of the distance measurement; and a controller in communication with the processor to receive the information signals and which controls the lifting equipment as a function of the information signals to authorize, prohibit, or limit one or more of (i) the ground movements for the lower portion and (ii) the movements for the lift structure in accordance with the at least one instruction.

2. The lifting equipment according to claim 1, wherein the safety system further comprises a winder with automatic return of the lanyard, and wherein the measuring sensor measures the length unwound between the first and second ends of the lanyard.

3. The lifting equipment according to claim 2, wherein the lanyard is kept tensed by the winder with automatic return.

4. The lifting equipment according to claim 2, wherein the measuring sensor is chosen from one of a multi-turn potentiometer, an optical or magnetic sensor, and a roller.

5. The lifting equipment according to claim 1, wherein the measuring sensor and processor are provided on the lanyard.

6. The lifting equipment according to claim 1, wherein the second end of the lanyard is fastened permanently to a safety harness configured to be worn by the person.

7. The lifting equipment according to claim 1, further comprising a remote electronic device that receives the information signals from the processor and replays the information signals.

8. The lifting equipment according to claim 1, wherein the safety system further comprises a temporal recording memory configured to record successive values of the distance measurement and usage events of the lanyard.

9. The lifting equipment according to claim 1, wherein the processor processes the distance measurement to emit a visual or sound warning signal when the distance measurement is smaller than a low value corresponding to an attached state for the person but not separated from the attachment point.

10. The lifting equipment according to claim 1, wherein the processor processes the distance measurement to emit a visual or sound warning signal when the distance measurement is substantially equal to a maximum value corresponding to a maximum length of the lanyard, indicating a fall state for the person.

11. The lifting equipment according to claim 1, wherein the processor combines sending the information signals with emitting visual or sound warning signals.

12. The lifting equipment according to claim 1, wherein the at least one instruction comprises an authorization instruction authorizing the ground movements for the lower portion without speed limit when the distance measurement is between a low value, corresponding to an attached state of the person but not separated from the attachment point, and an intermediate value above the low value, corresponding to an anti-ejection configuration of the person.

13. The lifting equipment according to claim 1, wherein the at least one instruction comprises a limitation instruction limiting a speed of the ground movements for the lower portion when the distance measurement is between an intermediate value, corresponding to an anti-ejection configuration of the person, and an edge value, corresponding to positioning the person on an edge of the platform.

14. The lifting equipment according to claim 1, wherein the at least one instruction comprises a prohibition instruction prohibiting one or more of (i) the ground movements for the lower portion, and (ii) the movements for the lift structure when the distance measurement is between an edge value, corresponding to positioning the person on an edge of the platform, and a maximum value, corresponding to a maximum length of the lanyard.

15. The lifting equipment according to claim 1, wherein the processor processes the distance measurement to emit a visual or sound warning signal when the distance measurement is greater than a maximum value corresponding to a maximum length of the lanyard, or when the distance measurement is smaller than a minimum value corresponding to the length of the lanyard fully wound.

16. The lifting equipment according to claim 1, wherein the processor processes the distance measurement to emit a visual or sound warning signal when the distance measurement does not vary over a period that is greater than a threshold duration.

17. The lifting equipment according to claim 1, wherein the information signals further include a failure signal indicating a failure for the measuring sensor when the distance measurement is greater than a maximum value corresponding to a maximum length of the lanyard, or when the distance measurement is smaller than a minimum value corresponding to the length of the lanyard fully wound.

18. The lifting equipment according to claim 1, wherein the information signals further include a non-attachment signal when the distance measurement is smaller than a low value corresponding to an attached state for the person but not separated from the attachment point, and wherein the controller emits a visual or sound warning signal when receiving the non-attachment signal.

19. The lifting equipment according to claim 1, wherein the information signals further include a falling signal when the distance measurement is substantially equal to a maximum value corresponding to a maximum length of the lanyard, and wherein the controller emits a visual or sound warning signal when receiving the falling signal.

* * * * *